United States Patent [19]

Raymond

[11] Patent Number: 4,610,198

[45] Date of Patent: Sep. 9, 1986

[54] DEVICE FOR TURNING PAPER IN VERSO-RECTO PRINTING

[75] Inventor: Flaujac Raymond, Creteil, France

[73] Assignee: Seailles & Tison SA, Vendome, France

[21] Appl. No.: 685,268

[22] Filed: Dec. 24, 1984

[30] Foreign Application Priority Data

Jan. 3, 1984 [FR] France ..... 84 00028

[51] Int. Cl.[4] ..... B41F 5/04; B65H 23/32

[52] U.S. Cl. ..... 101/223; 226/197; 226/199

[58] Field of Search ..... 101/247, 179–180, 101/220–223, 225, 257, 1; 226/197, 199

[56] References Cited

U.S. PATENT DOCUMENTS 2,221,930 11/1940 Stafford et al. ..... 101/1
3,542,621 11/1970 Calhoun, Jr. et al. ..... 226/197 X
3,623,645 11/1971 Klinger ..... 226/197
3,809,303 5/1974 Brunner ..... 226/197
3,906,855 9/1975 Laursen ..... 226/197 X
4,154,386 5/1979 Kawada ..... 226/197 X
4,412,639 11/1983 Caletti ..... 226/197

*Primary Examiner*—E. H. Eickholt
*Attorney, Agent, or Firm*—Cullen, Sloman, Cantor, Grauer, Scott, & Rutherford

[57] ABSTRACT

The present invention relates to a device for turning paper in verso-recto printing, adapted to be arranged on the path of the paper between two printing stations and having an assembly of turning bars which are angularly staggered with each other. The device has a fixed support forming a horizontal slide and extending perpendicularly to the path of the paper, and an upright removable body supporting the assembly of turning bars and adapted to be aligned in position and fixed on the support.

5 Claims, 7 Drawing Figures

DEVICE FOR TURNING PAPER IN VERSO-RECTO PRINTING

BACKGROUND OF THE INVENTION

The present invention relates to a device for turning paper in verso-recto printing.

Such devices are generally known and are provided for arrangement on the paper path between two printing stations so that the paper is either printed on one of its two faces, for example the verso, in the first printing station, and then turned by the turning device, or finally printed on its opposite face, for example the recto, in the second printing station.

In the known devices, the turning of the sheet is effected by means of an assembly of turning bars which are staggered angularly with each other. Usually an assembly of four bars are provided, staggered at 45° to each other, which permits turning the plane of the paper by four successive rotations of 45°.

The known devices still have a certain number of inconveniences caused by the fact that they are not demountable, access and cleaning is difficult, and that they cannot be adjusted as a function of the size of the paper to be turned.

THE INVENTION

The present invention relates to a device for turning paper in verso-recto printing which obviates these inconveniences.

According to the essential characteristic of the invention, the device comprises a fixed support forming a horizontal slide and extending perpendicularly to the paper advance path, and an upright removable body supporting an assembly of turning bars and adapted to be adjusted in position and fixed on the support.

In the preferred embodiment of the invention, the slide of the support has a section in the form of an invert T and the body is provided at its lower part with at least two studs each displaceable vertically under the action of a hand grip for fixing or unfixing the body on the support.

In the preferred embodiment, the support forming the slide extends over the length greater than double the maximum size of the paper, in order that the body can be displaced between a retracted position where it is out of the paper path and an operating position, adjustable as a function of the size of the paper, where the body is on the paper path.

DRAWINGS

Other characteristics and advantages of the invention will be better understood from reading the detailed description which follows and which refers to the accompanying drawings, in which.

PREFERRED EMBODIMENT

Figure 1:
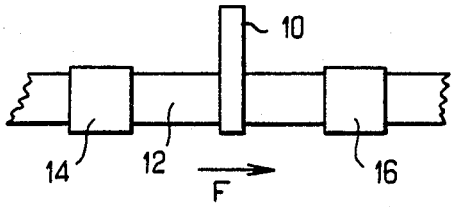
FIG. 1 is a schematic view from above showing the layout of the device of the invention between two successive printing stations.

As shown diagrammatically in FIG. 1, the paper turning device 10 according to the invention is intended to be arranged on the paper advance path 12 between two printing stations 14 and 16. The paper 12 which advances following the direction indicated by the arrow F is printed on one of its faces, for instance the verso, in the first station 14, and is then turned by the device 10 and is then printed on its opposite face, for example the recto, in the second station 16.

Figure 2:
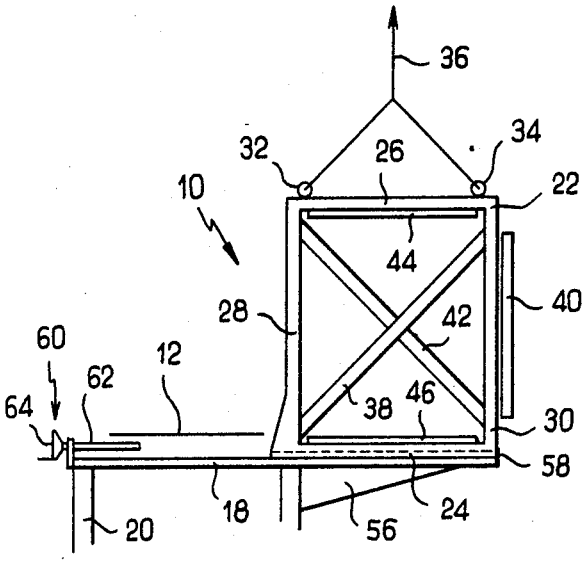
FIG. 2 is a side view of the device of the invention in a retracted position.
Figure 3:
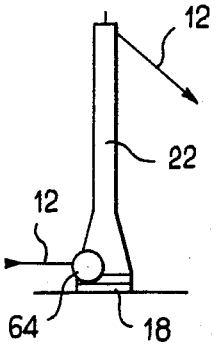
FIG. 3 is a side view of the body of the device of FIG. 2.
Figure 4:
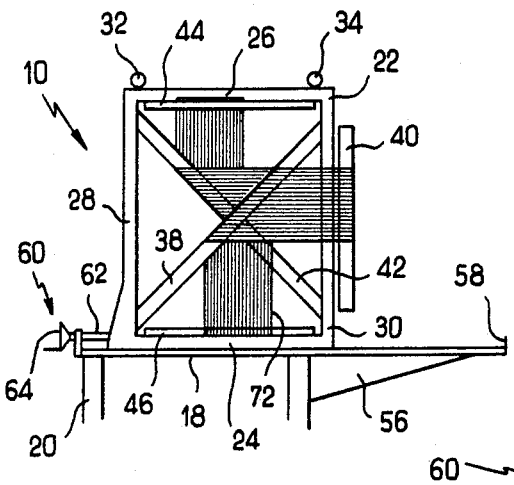
FIG. 4 is a view similar to FIG. 2 showing the body in its operating position corresponding to the minimum size of paper.
Figure 5:
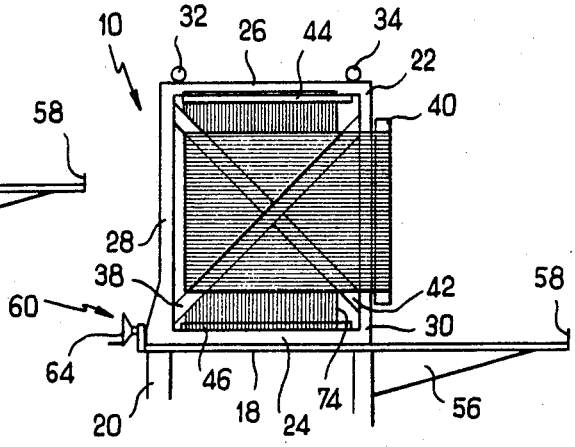
FIG. 5 is a view similar to that of FIG.4 showing the body in its operating position corresponding to the maximum size of the paper.

As shown more particularly in FIGS. 2,4 and 5, the device 10 comprises a fixed support 18, carried by a frame 20, which forms a horizontal slide and which extends perpendicularly to the paper path, and a removable vertical body 22 supporting an assembly of turning bars and adapted to be adjusted in position and fixed on the support 10.

The body 22 is a generally rectangular body which has a lower arm 24, an upper arm 26 and two vertical members 28 and 30. The lower arm 24 is provided with means, which will be described below, enabling the body to slide on the slide of the support 18 and to displace it between a retracted position (FIG. 2) and an operating position which is itself adjustable (FIG. 4 and FIG. 5).

The upper arm 26 is provided with rings 32 and 34 which permit lifting of the body by means of a lifting device 36 for placing the body on different supports on the same printing machine or even on a different printing machine of the same type.

The assembly of turning bars supported by the body 22 comprises a first horizontal return roller (this roller is not visible in FIG. 2 because it is hidden by the return roller 46 described later), a first oblique turning bar 38, a vertical turning roller 40, a second oblique turning bar 42, a horizontal turning roller 44 and a second horizontal return roller 46.

As one can see from FIG. 2, the two horizontal return rollers are supported at the level of the lower arm 24, whilst the oblique bars 38 and 42 are arranged approximately on the diagonals of the rectangle and the turning roller 40 is arranged close to the member 30 and the turning roller 44 is arranged close to the arm 26. The two return rollers, such as 46, an turning rollers 40 and 44 are rollers mounted freely on their respective axes. The roller 40, in a variant, can be driven at the speed of advance of the sheet of paper. On the other hand, the bars 38 and 42 are floating, that is to say hollow bars provided with apertures and connected to a source of compressed air in a manner to arrange a cushion of air about the bars for permitting sliding of the sheet of paper.

The bar 38, the roller 40, the bar 42 and the roller 44 are arranged successively at 45° to each other in a manner to submit the plane of the sheet of paper to four successive rotations of 45°.

Figure 6:
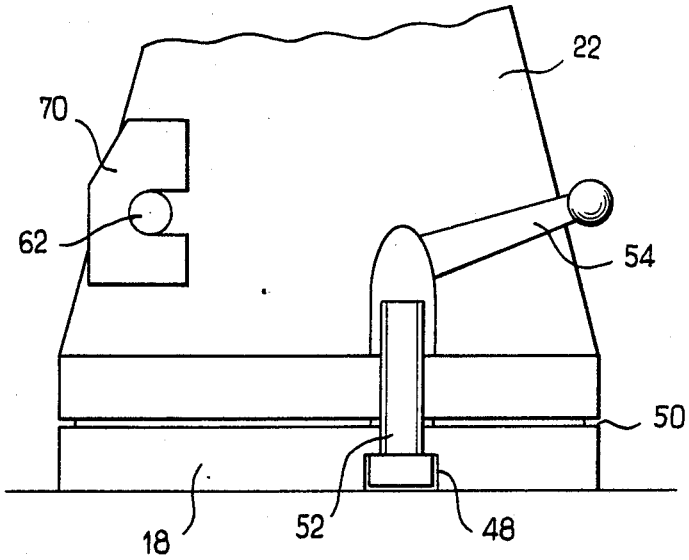
FIG. 6 is a side view showing in detail the base of the body of FIG. 3.

As shown in FIG. 6, the support 18 comprises a slide 48 which has an invert T-form section and which opens on the horizontal surface 50 of the support 18. The slide 48 serves to guide two studs 52 which are provided at the lower part of the body 22 and which are each displaceable under the action of a hand grip 54 for ensuring fixing or unfixing of the body 22 on the support 18. Each hand grip 54 has an internal thread adapted to cooperate with an external thread of the corresponding studs 52. Thus, on pivoting of the hand grip 54 in one direction or the other, the stud 52 is caused to rise or descend, which respectively causes the fixing or unfixing of the body and the support.

As one can see from FIGS. 2,4 and 5, the support 18 extends over a length greater than double the maximum size of paper (the paper 12 is shown with its maximum size in FIGS. 2 and 5) in order that the body 22 can be displaced between a retracted position (FIG. 2) where it is out of the path of the paper, and an operating position (FIG. 4 or FIG. 5) adjustable as a function of the size of the paper, where the body is in the path of the paper.

Also, as FIG. 2 shows, the support 18 has a portion arranged above the frame 20, below the paper 12, that is to say on the normal paper advance path, and a portion arranged out of alignment with the frame 20, this is out of alignment portion being supported by a strut 56.

The support 18 has, at one of its edges, an abutment 58 limiting the displacement of the body 22 in the retracted position (cf. FIG. 2) and at its opposite edge, a position adjusting means 60 adapted to act on the displacement of the body for adjusting the operating position (cf. FIGS. 4 and 5).

Figure 7:
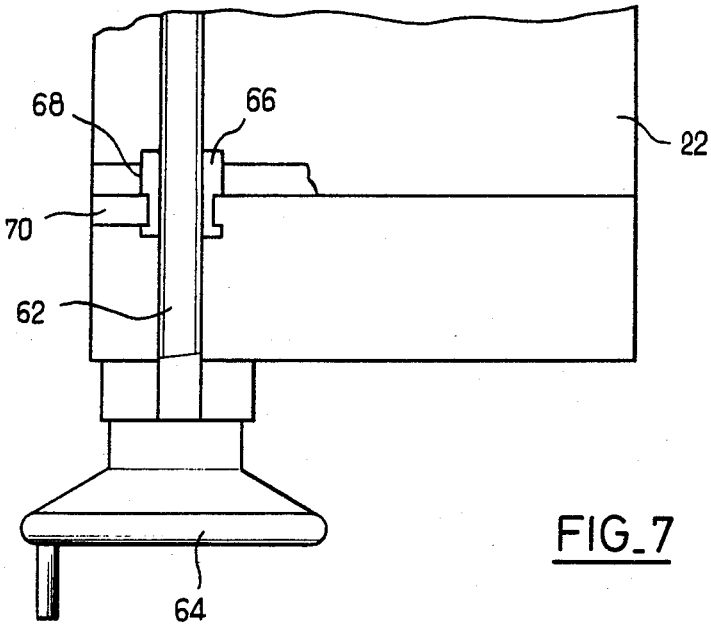
FIG. 7 is a plan view showing the setting of the position of the body of the support.

The adjusting means 60 has a threaded rod 62 directed parallel to the slide of the support, adapted to rotated by a hand grip 64 and cooperating with a nut 66 which can be fixed or unfixed to the body 22 (cf. FIG. 7) . The body 22 has for this a housing 68 for receiving the nut 66 and a pivoting lever 70 adapted to hold the nut in its housing.

The turning device of the invention is used in the following manner. The body 22 is transported by means of the lifting device from one support to another, either on the same printing machine, or from one printing machine to another. The body is arranged to descend onto the support in the position next to the retracted position where the two studs 52 can penetrate into the slide thanks to enlargements provided for this at appropriate places. Once the body is in position on the support, it can be moved either into the retracted position shown in FIG. 2, or into the operating position such as shown in FIGS. 4 and 5. For leading the body into the operating position, it is sufficient to displace it onto the slide driving it from the left (FIGS. 4 and 5) so that the threaded rod 62 of the adjusting means 60 can engage in the nut 66. When this engagement is made, the adjusting means 60 can be operated to adjust the precise position of the body. This adjustment of position can be facilitated by providing a rule (not shown) on the body and a scale shown) on the support. The adjustment of the operating position is intended to take account of the size of the overall width intended so that the paper is always centred with respect to the body and that one of the edges of the paper always has the same alignment. Also if FIGS. 4 and 5 are considered, it will be noted that the straight edge of the paper, that is the edge 72 of paper of minimum size (FIG. 4) or the edge 74 of paper of maximum size (FIG. 5) always has the same position whatever the size of the paper. The position adjustment of the body permits the perfect alignment of the straight edge of the paper with the specified alignment always to be held. Once the position adjustment is obtained, the body and the support are fixed together by screwing the two hand grips 54.

The turning device of the invention can thus be easily installed between two printing stations so as to be positioned in an operating position adjustable according to the function of the size of the paper or in a retracted position. There thus results a great flexibility since the two printing stations can be used either for verso-recto printing with different sizes, or for two successive recto recto printings with the turning device being retracted.

I claim:

1. In a device for turning paper in verso-recto printing, adapted to be arranged on the paper advance path between two printing stations and having an assembly of turning bars which are angularly staggered with each other, the improvement comprising:

a fixed support forming a horizontal slide and extending perpendicularly to the said paper path, and an upright removable body supporting said assembly of turning bars and adapted to be adjusted in position and fixed in said support, wherein said slide of said support has a section in the form of an inverted T and the body is provided at its lower part with:

at least two studs each displaceable vertically, and a respective hand grip for vertically displacing said studs for fixing and unfixing said body on said support.

2. A device according to claim 1, wherein said support forming said slide extends over a length greater than double the maximum size of the paper, in order that said body can be displaced between a retracted position where it is out of said paper path and an operating position, adjustable as a function of the size of said paper, where said body is on said paper path.

3. A device according to claim 2, wherein said support forming said slide has, at one of its ends, an abutment limiting the displacement of said body in said retracted position and, at its either end, position adjusting means adapted to effect the displacement of said body for adjusting the operating position.

4. A device according to claim 3, wherein said position adjusting means has a threaded rod directed parallel to said slide of said support, a handgrip for rotating said threaded rod, and a nut cooperating with said threaded rod, which can be fixed and unfixed from said body.

5. A device according to claim 4 wherein said body has a housing for receiving said nut and a pivoting lever adapted to hold said nut in its housing.

* * * * *